US009560879B2

(12) United States Patent
Wu et al.

(10) Patent No.: US 9,560,879 B2
(45) Date of Patent: Feb. 7, 2017

(54) TOBACCO SHRED FEEDING TREATMENT DEVICE AND METHOD FOR IMPROVING HEAT ENERGY AND FEED LIQUID ABSORPTION EFFICIENCY OF TOBACCO SHRED

(71) Applicant: Xiamen Tobacco Industrial Co., Ltd, Fujian (CN)

(72) Inventors: Yusheng Wu, Fujian (CN); Yuefei Zhou, Fujian (CN); Rongxin Lin, Fujian (CN); Hong Huang, Fujian (CN); Daoquan Wang, Fujian (CN); Tuo Lin, Fujian (CN); Jichun Qian, Fujian (CN); Jindong Xie, Fujian (CN); Jing Luo, Fujian (CN)

(73) Assignee: Xiamen Tobacco Industrial Co., Ltd., Fujian (CN)

( * ) Notice: Subject to any disclaimer, the term of this patent is extended or adjusted under 35 U.S.C. 154(b) by 144 days.

(21) Appl. No.: 14/460,675

(22) Filed: Aug. 15, 2014

(65) Prior Publication Data

US 2015/0047657 A1 Feb. 19, 2015

(30) Foreign Application Priority Data

Aug. 16, 2013 (CN) ..... 2013 1 0357315

(51) Int. Cl.
*A24B 3/04* (2006.01)
*A24B 13/02* (2006.01)

(52) U.S. Cl.
CPC *A24B 13/02* (2013.01); *A24B 3/04* (2013.01)

(58) Field of Classification Search
USPC ..... 131/290, 300, 302–306
See application file for complete search history.

(56) References Cited

U.S. PATENT DOCUMENTS 3,948,277 A * 4/1976 Wochnowski ..... A24B 3/04 131/303
4,054,145 A 10/1977 Berndt et al.
(Continued)

FOREIGN PATENT DOCUMENTS

CN 101258946 9/2008
CN 201188867 2/2009
(Continued)

OTHER PUBLICATIONS

English Translation of CN-203467649, 2012,EPO and Google Translate, European Patent Office, [online], retrieved from the Internet, [retrieved Feb. 27, 2016], <URL:http://translationportal.epo.org/emtp/translate/?ACTION=claims-retrieval&COUNTRY=CN&ENGINE=google&FORMAT=docdb&KIND=U&LOCALE=en_EP&NUMBER=203467649&OPS=ops.epo.org/3.1&SRCLANG=zh&TRGLANG=en.*
(Continued)

*Primary Examiner* — Dennis Cordray
(74) *Attorney, Agent, or Firm* — Kilpatrick Townsend & Stockton

(57) ABSTRACT

The invention relates to a tobacco shred feeding treatment device and a method for improving the heat energy and feed liquid absorption efficiency of tobacco shred, comprising: a tobacco shred feeding machine, said tobacco shred feeding machine mainly comprises a roller, a process warm-air pipe, a power blower, a heater, a steam nozzle, a feed liquid nozzle and an air inlet pipe; the process warm-air is blown into said roller from said air inlet pipe via said steam nozzle and said heater under the action of said power blower, and mixed with the tobacco shred; said air inlet pipe is provided directly under the central axis of said roller; the opening of said air inlet pipe faces up obliquely, and the opening direction of which could be adjusted into any position within the roller according to the requirements; said steam nozzle is mounted between the power blower and the heater, to achieve heating
(Continued)

the condensed water in the steam, and to avoid directly injecting the steam to burn the tobacco shred. Under the premise that it is not necessary to configure the tunnel heating and humidifying equipment, the process warm-air with steam can contact with the tobacco shred sufficiently to improve the heat energy and feed liquid absorption efficiency and uniformity.

8 Claims, 2 Drawing Sheets

(56) References Cited

U.S. PATENT DOCUMENTS

| | | | | |
|---|---|---|---|---|
| 4,255,869 | A * | 3/1981 | Quester | A24B 3/04 34/483 |
| 5,676,164 | A | 10/1997 | Martin | |
| 5,711,320 | A | 1/1998 | Martin | |

FOREIGN PATENT DOCUMENTS

| | | |
|---|---|---|
| CN | 201967624 | 9/2011 |
| CN | 102415609 | 4/2012 |
| CN | 202364783 | 8/2012 |
| CN | 202407059 | 9/2012 |
| CN | 203467649 | 3/2014 |
| EP | 0629351 | 12/1994 |

OTHER PUBLICATIONS

Chinese Office Action mailed on May 29, 2015 for CN Patent Application No. 201310357315.7, with Machine translation, 15 pages.

Office Action for Chinese Appl. No. 201310357315.7 dated Oct. 20, 2014.

* cited by examiner

TOBACCO SHRED FEEDING TREATMENT DEVICE AND METHOD FOR IMPROVING HEAT ENERGY AND FEED LIQUID ABSORPTION EFFICIENCY OF TOBACCO SHRED

CROSS-REFERENCE TO RELATED APPLICATION

This is a US Non-Provisional Application which claims priority to Chinese Patent Application No. 201310357315.7 filed on Aug. 16, 2013, the entirety of which is incorporated herein by reference.

FIELD OF THE INVENTION

The invention relates to the field of tobacco electrical automatic control, particularly to a tobacco shred feeding treatment device and a method for improving the heat energy and feed liquid absorption efficiency of tobacco shred.

BACKGROUND OF THE INVENTION

At present, during the manufacturing of tobacco shred making, there are two kinds of feeding treatment processes: tobacco flake feeding treatment process and tobacco shred feeding treatment process. The traditional shred making production lines all use tobacco flake feeding treatment process. In recent years, the tobacco shred feeding treatment process is increasingly applied in the cigarette production lines. FIG. 1 shows the structure schematic drawing of the existing tobacco shred feeding treatment device. As shown in FIG. 1, the tobacco shred feeding treatment device includes a tobacco shred feeding machine, a vibration groove 1' and a tunnel heating and humidifying equipment 2', the vibration groove 1' and the tunnel heating and humidifying equipment 2' are provided orderly in the feeding end of tobacco shred feeding machine (the right side of tobacco shred feeding machine shown in FIG. 1). After being heated and humidified by the tunnel heating and humidifying equipment 2', the tobacco shred is conveyed to the tobacco shred feeding machine via the vibration groove 1' to get the feeding treatment.

The tobacco shred feeding machine includes a roller 3', a process warm-air pipe 4', a power blower 5', a heater 6', a steam nozzle 7', a feed liquid nozzle 8' and an air inlet 9'. The process warm-air A' is blown by the power blower 5', via the hot blast heater 6' from the position above the central axis of the roller 3', and flows into the roller 3' in the same direction as the tobacco shred conveyed from the vibration groove 1', and mixed with the tobacco shred. At the same time, the tunnel heating and humidifying equipment 2' implements the heating and humidifying of tobacco shred, and the suitable temperature and humidity is advantageous to improve the feed liquid absorption rate of tobacco shred. The arrow direction B' depicted in FIG. 1 indicates the direction of the process warm-air A' with steam, the arrow direction C' indicates the moisture removal direction in the system, and the arrow direction D' indicates the tobacco shred conveying direction.

The method of processing tobacco shred by the prior tobacco shred feeding treatment device has the following disadvantages:

1. The process warm-air A' is blown into the roller 3' at positions above the central axis of the roller 3', only contacts with the tobacco shred falling down from above, has a small contact area with tobacco shred, cannot make sufficient heat exchange with the inner tobacco shred, which lead to the temperature and the moisture content of the tobacco shred cannot meet the process requirements. In order to ensure that the tobacco shred meet the process requirements of the temperature and the moisture content, it is necessary to increase the steam pressure to increase the steam injection amount and the speed of the process warm-air, so that the process warm-air with steam and feed liquid in the roller 3' is directly blown to the end of the roller 3' in the case of having not contacted with the tobacco shred and being absorbed sufficiently, and most of them are removed by the moisture removing blower 10', easily to cause the phenomenon of tobacco shred moisture content and feed liquid absorption uneven and cause the waste of feed liquid and energy. At the same time, some of the feed liquid adhere onto the mesh belt of the moisture removing port C', as time goes by, the feed liquid adhering onto the mesh belt will drop into the tobacco shred at the discharging port, easily to cause the appearance of macular tobacco.

2. The condensed water will be produced when the process warm-air A' with steam come into contact with the low temperature process warm-air pipe, the condensed water goes into the feeding machine along with the process warm-air A', and mixes directly with the tobacco shred, causing wet mass and water staining tobacco, which is disadvantageous for the manufacture of subsequent work-stage and affects the quality of tobacco shred.

3. The tunnel heating and humidifying equipment 2' need to be configured in the front end, and the equipment is easily to cause uneven tobacco shred moisture content, and the tobacco shred wet mass and scaling is easily to produce, which lead to the sensory quality reduction of tobacco shred. At the same time, the tunnel heating and humidifying equipment 2' is a tobacco shred equipment having high energy consumption and serious environmental pollution problem, with high workload of daily cleaning and maintenance.

4. The steam nozzle 7' is provided in the feeding end of the roller 3', with the condensed water in the steam directly spraying onto the tobacco shred, causing tobacco shred wet mass and water staining tobacco. Internationally, there are some devices related to steam absorption efficiency of tobacco flake or tobacco shred, which adopt the way of steam nozzle directly injecting to the feed, easily to cause tobacco leaves or tobacco shred burnt, and more easily to cause obvious falling sensory quality reduction particularly for higher quality of flue-cured tobacco.

BRIEF DESCRIPTION OF DRAWINGS

Here the accompany drawings forming part of the present application are shown to provide further understanding of the invention. The exemplary embodiments of the invention and the description thereof are used to explain the invention, and do not constitute the unsuitable limitation for the invention. In the accompany drawings.

DETAILED DESCRIPTION OF THE INVENTION

Hereinafter, with reference to the accompany drawings and embodiments, the technical solution of the invention will be further described in detail.

Figure 1:
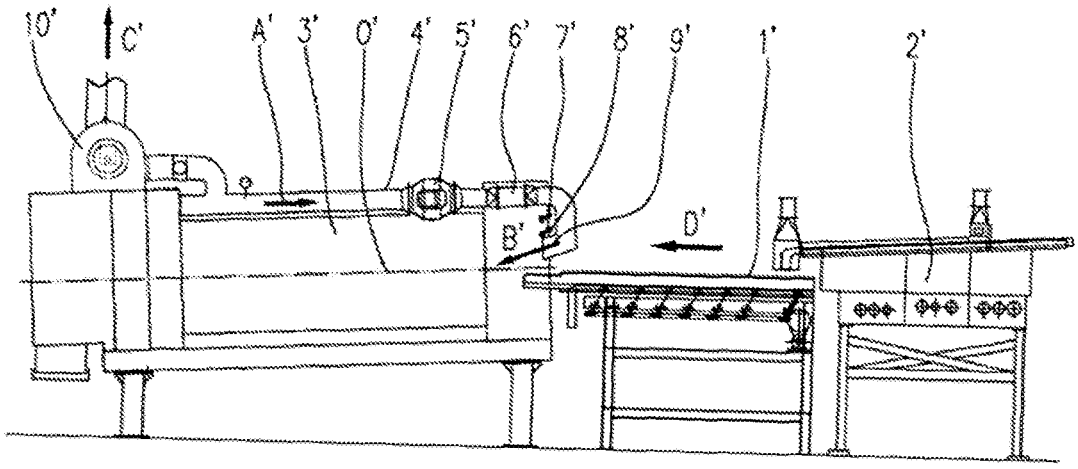
Fig. 1 PRIOR ART
FIG. 1 is a structural schematic view of a tobacco shred feeding treatment device in prior art.
Figure 2:
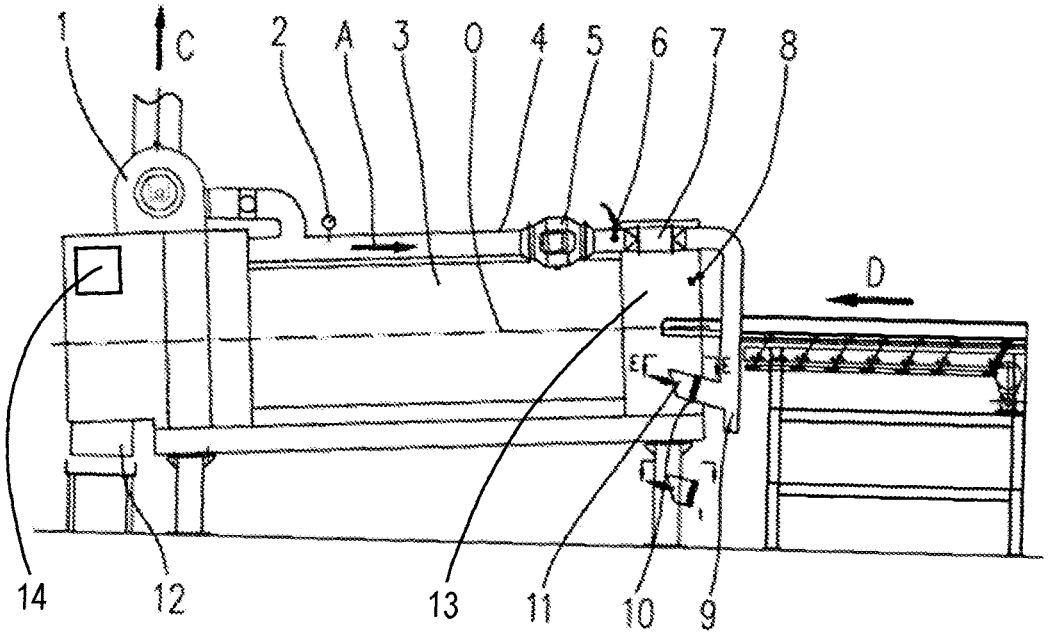
FIG. 2 is a schematic view of a tobacco shred feeding treatment device for improving the heat energy and feed liquid absorption efficiency of tobacco shred according to the present invention.

As shown in FIG. 2, the tobacco shred feeding treatment device provided by the present invention for improving the heat energy and feed liquid absorption efficiency of tobacco shred includes a tobacco shred feeding machine and a vibration groove, the feeding end of the tobacco shred feeding machine (the right end of the tobacco shred feeding machine as shown in FIG. 2) does not need to configure the tunnel heating and humidifying equipment. Since the tunnel heating and humidifying equipment is easily to cause uneven tobacco shred moisture content, and the tobacco shred wet mass and scaling is easily to produce, which lead to the sensory quality reduction; meanwhile, the tunnel heating and humidifying equipment is a tobacco shred equipment having high energy consumption and serious environmental pollution problem, with high workload of daily cleaning and maintenance, so the present invention not only ensures the sensory quality stability of the tobacco shred, but also reduces the energy consumption and environmental pollution, and cuts down the device investment and the cost of daily operation and maintenance.

What's same with prior art is that: the tobacco shred feeding machine mainly comprises a roller 3, a process warm-air pipe 4, a power blower 5, a steam nozzle 6, a heater 7, a feed liquid nozzle 8 and an air inlet pipe 11. The process warm-air A is blown by the power blower 5, via the heater 7, from the air inlet pipe 11 into the roller 3, and mixed with the tobacco shred.

What's different from prior art is that: the air inlet pipe 11 is provided directly under the central axis of the roller 3, the opening of the air inlet pipe 11 faces up obliquely. As can be seen from FIG. 2, the opening of the air inlet pipe 11 is tilting upward, the process warm-air with the steam sprayed from the air inlet pipe 11 is spraying upward obliquely from the lower part, and sufficiently contacts with the largely loosened tobacco shred falling from the height, solved the following disadvantages in the prior art: the process warm-air A is blown into the positions above the central axis of the roller 3' by a fixed air inlet pipe in the prior art, only contacts with the tobacco shred falling down from above, has a small contact area with tobacco shred, and cannot make sufficient heat exchange with the inner tobacco shred. The blowing mode from upper to lower in the present invention will increase the contact area with tobacco shred significantly, thus making the heat energy absorption of tobacco shred more sufficient and more uniform.

On the basis of the structure of prior tobacco shred feeding treatment device, the tunnel heating and humidifying equipment 2' is omitted in the present invention, the original fixed air inlet pipe is changed into an angle-adjustable air inlet pipe, depending on the difference of the feed flow and the speed of the roller, by adjusting the suitable angle of air inlet pipe 11, the process warm-air A is ensured to contact with tobacco shred sufficiently, and the heat exchange and the feed liquid absorption are made uniformly, reducing the phenomenon of tobacco shred adhering onto the roller significantly, and reducing the waste of feed liquid and energy. The process warm-air speed within the roller 3 is adjusted to be 1.0 to 2.0 times of the travelling speed of tobacco shred in the roller 3 by adjusting the frequency of the power blower 5, further ensuring the time of the heat energy and feed liquid absorption of tobacco shred, reducing the wastage of process warm-air A with feed liquid due to being discharged by the moisture removing system.

A universal joint 10 is also provided, and it can be achieved that the opening of the air inlet pipe 11 may adjust its opening direction into any position within the roller according the requirements, with the universal joint as its center. The air inlet pipe 11 is in communication with the air outlet of the process warm-air pipe 4 via the universal joint 10. In this embodiment, the universal joint 10 is made of a food grade soft material having high temperature resistance, moisture resistance and good toughness, which can be directly available from the market.

In the above mentioned embodiment, as shown in FIG. 2, the air inlet pipe 11 may be either a square pipe, or a circular or oval pipe. However, whatever the shape of the air pipe is, in order to make sure that not only the air flow can go into the roller 3 via the air inlet pipe 11, but also the tobacco shred 11 falling from the upper portion of roller 3 will not fall into the opening of the air inlet pipe 11, the opening end surface of the air inlet pipe 11 is provided as tilting surface, and the upper wall of the air inlet pipe 11 is longer than its lower wall.

In the above-mentioned embodiment, the process warm-air pipe 4 is tilting upward in the upper portion of the roller 3 in relation to the direction of process warm-air, the steam nozzle 6 is installed between the power blower 5 and the heater 7, and at the same time injects the steam perpendicular to the process warm-air pipe 4, so that the condensed water carried in the steam can be discharged from the lowest point of the process warm-air pipe 4, avoiding to go into the heater 7 that cause the heater 7 bear heat-expansion and cold-contraction frequently to affect its service life; avoiding the high temperature steam to have an impact on the performance of power blower 5; solving the tobacco shred's burn caused by the high temperature steam injecting directly onto the tobacco shred to increase the temperature, especially avoiding the sensory quality reduction for higher quality of flue-cured tobacco; the injecting steam and the process warm-air are sufficiently mixed before go into the roller 3, with the uniformity of tobacco shred heat absorption improved.

In the above mentioned embodiments, the present invention may also include the condensed water collecting pipe 9, and the condensed water collecting pipe 9 is in communication with the air outlet of the process warm-air pipe 4, and the opening of the condensed water collecting pipe 9 faces downward, by providing the condensed water collecting pipe in the air outlet of the process warm-air pipe 4, the condensed water is completely prevented to go into the roller 3 with the process warm-air, the production of tobacco shred wet mass of and water staining tobacco is reduced, and the tobacco shred feeding effectiveness and the quality stability are improved.

In the above mentioned embodiments, the bottom surface of the condensed water collecting pipe 9 is provided with a device such as a spring sheet which airflow cannot go through but a preset amount of condensed water can go through due to gravity (not shown in the drawings), the area of the spring sheet is enough to completely cover the bottom opening of the condensed water collecting pipe 9, and one end of the spring sheet is fixedly connected to the bottom of the condensed water collecting pipe 9, while the other end is in suspension. Therefore, when the weight of condensed water on the spring sheet is not enough to push the spring sheet away, the suspension end of the spring sheet is affixed to the bottom surface of the condensed water collecting pipe 9, making the airflow cannot to go through.

In the above embodiments, the invention also comprises a temperature detection mechanism 2, the temperature detection portion of said temperature detection mechanism 2 is located inside the return air portion of said process warm-air pipe 4; the temperature display portion of said temperature detection mechanism 2 is located outside of said process warm-air pipe 4, and the temperature of the return air portion in said process warm-air pipe 4 can be detected with said temperature detection mechanism 2. By slightly adjusting the frequency of the power blower 5 and the steam injection amount of the steam nozzle 6, the difference value between the temperature of the return air part in the process warm-air pipe and the tobacco shred temperature at the discharging port 12 of the roller is within 1° C., and the temperature of the tobacco at the exit of the roller is ensured to meet the process requirements. Therefore, the effectiveness and uniformity of heat energy and the feed liquid absorption of tobacco shred are further ensured;

The invention also provides a tobacco shred feeding treatment method using the tobacco shred feeding treatment device mentioned in the above embodiments, including the following steps:

1) Parameter design. When the controlling belt weigher 13 in the front section workstage of the feeding machine sends out the feed presence signal, starting the steam nozzle (6) of tobacco shred feeding machine after a period of time to inject steam into the process warm-air (A) for heating the tobacco shred; opening the feeding nozzle (8) after another period of time to feed the heated tobacco shred;

2) Starting the production line, preheating the equipment, and making the physical tests after the completion of preheating;

3) Observing the throwing trajectory and throwed state of the tobacco shred after being delivered into the tobacco shred feeding machine under the action of rake nail, and in the case of continuous production, finding out an area which is most loose and in which the feed layer throwing surface is the largest during the tobacco shred throwing course at the feeding end in the roller 3;

4) Adjusting the orientation of the air inlet pipe 11, turning the opening direction of the air inlet pipe 11 directly opposite to the area which is most loose and in which the feed layer throwing surface is the largest during the tobacco shred throwing course selected from step 3);

5) Adjusting the steam injection amount of the steam nozzle 6 applied to the process warm-air pipe 4, and adjusting the temperature of the tobacco shred after being treated by the roller 3, such that the process requirements is fulfilled;

6) Adjusting the frequency of the power blower 5, such that the process warm-air speed within the roller 3 is adjusted to be 1.0 to 2.0 times of the travelling speed of tobacco shred in the roller 3 (the air speed in the roller 2 is generally designed to be 8-10 times of the flow rate of tobacco shred in the device manufactory), preferably making the steam inside the roller 3 just not to overflow;

7) Slightly adjusting the frequency of the process warm-air power blower 5 and the steam injection amount of steam nozzle 6:

Detecting the tobacco shred temperature in the discharging port 12 of the roller 3, and comparing it with the temperature detected by the temperature detection mechanism 2. When the temperature difference between them is greater than 1° C., reducing the frequency of the power blower 5 gradually, until the temperature difference between them is within 1° C.

Compare the temperature collected by the temperature detection mechanism 2 with the set value of the process requirements. When the collected temperature is higher than the process requirements, the steam injection amount of the steam nozzle 6 will be gradually reduced; when the collected temperature is lower than the process requirements, the steam injection amount of the steam nozzle 6 will be gradually increased, until the collected temperature conforms to the process requirements.

In the above method, the method of the present invention may also include the step of slightly adjusting the frequency of the power blower 5 and the steam injection amount of the steam nozzle 6, at the same time comparing the tobacco shred temperature in the discharging port 12 of the roller 3 with the temperature detected by the temperature detection mechanism 2, until the temperature difference between them being within 1° C. Therefore, the heat energy and feed liquid absorption efficiency and uniformity of tobacco shred is further ensured.

In the above method, the method of the present invention may also include the step of collecting condensed water generated in the process warm-air pipe 4 with the condensed water collecting pipe 9. The original fixed air inlet is changed into an angle-adjustable air inlet in the method of the present invention, at the same time, the condensed water collecting pipe 9 is provided in the air outlet of the process warm-air pipe 4, and the condensed water is completely prevented to go into the feeding roller 3 with the process warm-air.

Now the invention will be described in an example of a tobacco shred feeding machine of 3000 kg/h, in combination with the accompany drawings and the embodiments.

1) Parameter Design

The speed of the roller 3 is set to 10 RPM;

The rotation direction of the roller: in clockwise direction as seen from the feed direction;

The pressure of the steam nozzle 6 is set to 1.6 bar;

The frequency of the power blower 5 is set to 6 Hz;

The frequency of the moisture removing blower 1 is set to 6 Hz;

The process return air temperature 2 is set to 50° C.;

The pilot injection pressure of the feeding nozzle 8 is set to 0.8 bar.

Settings of the preheating mode: starting the roller 3, the heater 7, the power blower 5 simultaneously, turning off the moisture removing blower 1, the preheating will be completed when the process warm-air is preheated to 70° C. (collected by the temperature detection mechanism 2), and waiting for the feed.

Settings of the production mode: When the controlling belt weigher 13 in the front section workstage of the feeding machine sends out the feed presence signal, starting the steam nozzle 6 of tobacco shred feeding machine after a delay of 25 seconds to inject steam into the process warm-air A, and heating the tobacco shred going into the roller 3, opening the feeding nozzle 8 after another delay of 15 seconds to feed the heated tobacco shred, at the same time starting, the moisture removing blower 1, then the normal production starts.

2) Starting the production line, making physical test according to the process parameters set in step 1).

3) Observing the throwing trajectory and throwed state of the tobacco shred after being delivered into the tobacco shred feeding machine under the action of rake nail, and finding out an area which is most loose and in which the feed layer throwing surface is the largest during the tobacco shred throwing course at the feeding end in the roller 3.

Figure 3:
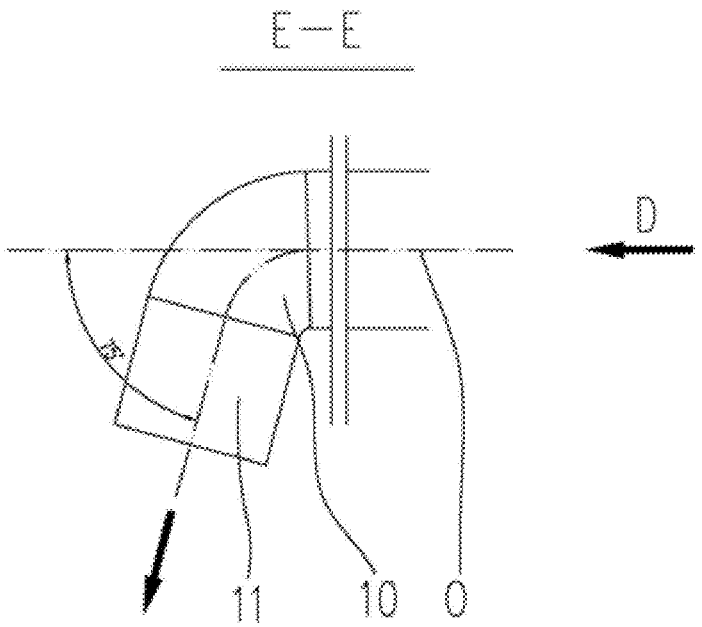
FIG. 3 is an orientation schematic view of an embodiment of air inlet pipe.

4) Adjusting the orientation of the air inlet pipe 11, turning the opening direction of the air inlet pipe 11 directly opposite to the area which is most loose and in which the feed layer throwing surface is the largest during the tobacco shred throwing course selected from step 3). At this time the air inlet pipe 11 is inclined upward at an elevation angle of 45°, as shown in FIG. 3, turning left 75° as seen from the feed flow direction.

5) Slightly adjusting the steam injection amount of steam nozzle 4 and the frequency of the power blower 3:

The temperature collected by the temperature detection mechanism 2 is automatically compared with the return air temperature in the process requirements (the set value is 50° C.), the automatic control system 14 automatically adjusts the steam injection amount of the steam nozzle 6.

Detecting the tobacco shred temperature in the discharging port 12 of the roller 3, and comparing it with the temperature detected by the temperature detection mechanism 2 in the return air portion of the process warm-air pipe 4, the temperature difference between them is merely 0.6° C., and conform to the requirements of the above method. Therefore, it is not necessary to adjust the frequency of the power blower 5.

Through the above adjustment, the heat energy of the process warm-air and the feed liquid are sufficiently absorbed by the tobacco shred, the moisture removing air flow is reduced from 2650 $m^3/h$ to 318 $m^3/h$, greatly reducing the wastage of the energy and the feed liquid. The condensed water collecting pipe is provided in the air outlet to eliminate the event of the condensed water going into the feed roller with the process warm-air, no wet mass and water staining tobacco is found, with the amount of tobacco shred affixing the roller being significantly reduced. The moisture content standard deviation of the outlet tobacco shred is only 0.10, and the outlet temperature standard deviation is only 0.15, improving the effectiveness and uniformity of the heat energy and the feed liquid absorption of tobacco shred significantly. At the same time, the tobacco shred wet mass and scaling is solved, and greatly improving the sensory quality of tobacco shred.

Finally, it should be understood that, the above mentioned embodiments are disclosed only for illustrative purposes and not limitative. Although the invention is described in detail with reference to the preferred embodiments, those skilled in the art will appreciate that modifications could be made for the specific implementation or equivalent substitution could be made for part of technical features without departing from spirit of the technical solution of the invention, all of which should be included in the scope of the claimed technical solution of the present invention.

We claim:

1. A tobacco shred feeding treatment device for improving the heat energy and feed liquid absorption efficiency of tobacco shred, comprising:

a tobacco shred feeding machine, said tobacco shred feeding machine mainly comprises a roller (3), a process warm-air pipe (4), a power blower (5), a steam nozzle (6), a heater (7), a feed liquid nozzle (8) and an air net pipe (11);

process warm-air (A) is blown into said roller (3) from said air inlet pipe (11) through said steam nozzle (6) and said heater (7) mounted on the process warm-air pipe (4) under the action of said power blower (5), and mixed with tobacco shred in said roller (3);

characterized in that:

said air net pipe (11) is provided directly under the central axis of said roller (3);

an opening of said air inlet pipe (11) faces up obliquely with respect to the horizontal direction, and the opening of said air inlet pipe (11) is adjustable into any direction within the roller (3) according to the requirements via a universal joint (10) between an air outlet of said process warm-air pipe (4) and the opening of said air inlet pipe (11).

2. The device according to claim 1, wherein said air net pipe (11) is in communication with an air outlet of said process warm-air pipe (4) via said universal joint (10).

3. The device according to claim 2, wherein the upper wall of said air inlet pipe (11) extends further than a lower wall of said air inlet pipe.

4. The device according to claim 3, further comprising a condensed water collecting pipe (9), said condensed water collecting pipe (9) is in communication with the air outlet of said process warm-air pipe (4), and an opening of said condensed water collecting pipe (9) faces downward to discharge condensed water.

5. The device according to claim 4, wherein the opening of said condensed water collecting pipe (9) is covered with a device which airflow cannot go through but a preset amount of condensed water can go through due to gravity.

6. The device according to claim 5, further comprising a temperature detection mechanism (2) comprising a temperature detection portion located inside the return air portion of said process warm-air pipe (4) and a temperature display portion located outside of said process warm-air pipe (4).

7. The device according to claim 6, wherein said steam nozzle (6) is mounted between the power blower (5) and the heater (7), and is arranged perpendicular to the process warm-air pipe (4).

8. The device according to claim 7, wherein a portion of said process warm-air pipe (4) is located above the roller (3) and is tilting upward at an angle.

* * * * *